US007863835B2

(12) United States Patent
Lin et al.

(10) Patent No.: US 7,863,835 B2
(45) Date of Patent: Jan. 4, 2011

(54) FLAT PANEL DISPLAY HAVING BACKLIGHT MODULE

(75) Inventors: Wen-Tsung Lin, Tainan (TW); Shih-Ming Chen, Tainan (TW); Ching-Liang Lin, Daliao Shiang (TW)

(73) Assignee: Chimei Innolux Corporation, Miao-Li County (TW)

( * ) Notice: Subject to any disclaimer, the term of this patent is extended or adjusted under 35 U.S.C. 154(b) by 0 days.

(21) Appl. No.: 11/747,850

(22) Filed: May 11, 2007

(65) Prior Publication Data

US 2007/0267985 A1 Nov. 22, 2007

(30) Foreign Application Priority Data

May 12, 2006 (TW) ..... 95117008 A

(51) Int. Cl.
*H05B 37/00* (2006.01)

(52) U.S. Cl. ..... 315/312; 315/209 R; 315/291; 345/102

(58) Field of Classification Search ..... 315/209 R, 315/291, 307, 312; 345/87, 102; 362/559, 362/561, 600, 608, 611, 613
See application file for complete search history.

(56) References Cited

U.S. PATENT DOCUMENTS 5,971,567 A * 10/1999 Van Duijneveldt ..... 362/296
5,975,722 A * 11/1999 Van Duijneveldt ..... 362/296
6,674,250 B2 * 1/2004 Cho et al. ..... 315/291
7,195,367 B2 * 3/2007 Hong et al. ..... 362/97.3
7,314,288 B2 * 1/2008 Wakabayashi ..... 362/225
7,354,173 B2 * 4/2008 Ono ..... 362/247
2002/0036608 A1 * 3/2002 Hirakata et al. ..... 345/87
2004/0113883 A1 * 6/2004 Kim et al. ..... 345/102
2005/0099143 A1 * 5/2005 Kohno ..... 315/312
2005/0179831 A1 8/2005 Kaneki et al. ..... 349/58
2005/0269973 A1 * 12/2005 Jang et al. ..... 315/307
2006/0002106 A1 * 1/2006 Hong et al. ..... 362/224
2006/0109234 A1 * 5/2006 Hong et al. ..... 345/102
2006/0139952 A1 * 6/2006 Inoue et al. ..... 362/613
2006/0146570 A1 * 7/2006 Park ..... 362/613
2006/0255900 A1 * 11/2006 Kohno ..... 336/212
2007/0024570 A1 * 2/2007 Kumamoto ..... 345/102
2007/0171677 A1 * 7/2007 Yano et al. ..... 362/614

FOREIGN PATENT DOCUMENTS

CN 1638594 7/2005

* cited by examiner

*Primary Examiner*—Douglas W Owens
*Assistant Examiner*—Tung X Le
(74) *Attorney, Agent, or Firm*—Fish & Richardson P.C.

(57) ABSTRACT

A display includes a backlight module having elongated lamps. At least a pair of the lamps has a first lamp and a second lamp that are electrically connected in series. The first lamp and the second lamp are spaced apart with at least a third lamp positioned between the first and second lamps.

30 Claims, 10 Drawing Sheets

FLAT PANEL DISPLAY HAVING BACKLIGHT MODULE

CROSS REFERENCE TO RELATED APPLICATIONS

The application claims priority to Taiwan Application No. 95117008, filed May 12, 2006, the contents of which are incorporated by reference.

BACKGROUND

This document relates to flat panel displays having backlight modules.

FIG. 1 is a diagram of an example of a conventional backlight module 100 of a liquid crystal display (LCD) panel. The backlight module 100 includes straight cold cathode fluorescent lamps (CCFLs) 102 positioned in parallel to one another. Ballast capacitors 104 are positioned at two ends of each CCFL 102. External electrode fluorescent lamps (EEFL) can also be used in the backlight module 100.

FIG. 2 is a diagram of another example of a conventional backlight module 100 that uses "quasi-U lamps" L1 to L6, each being formed by series connecting adjacent straight CCFLs to form a quasi-U-shaped lamp. For example, a quasi-U-shaped lamp L1 includes lamps C1 and C2 that are adjacent and in parallel to each other, in which an end 112*a* of the lamp C1 is connected to an end 112*b* of the lamp C2, forming a quasi-U-shape. The lamp C1 has an end 114*a* that is connected to a power source A1 through a ballast capacitor, and the lamp C2 has an end 114*b* that is connected to a power source A2 through a ballast capacitor.

SUMMARY

In one aspect, in general, a display includes a backlight module having elongated lamps that include at least a pair of lamps having a first lamp and a second lamp that are electrically connected in series and being spaced apart with at least a third lamp positioned between the first and second lamps.

Implementations of the display may include one or more of the following features. The lamps are connected in pairs in which the pairs of lamps are selected to compensate for differences in temperatures of the lamps during operation of the lamps. The pair of lamps are connected in a quasi-U-shape. The apparatus includes a circuit board having at least one signal line for connecting the at least one pair of lamps. The elongated lamps extend along directions that are parallel to one another. The backlight module includes an inverter to provide power to the lamps. The first lamp has a first end electrically coupled to the inverter, the second lamp has a first end electrically coupled to the inverter, and the first lamp has a second end electrically coupled to a second end of the second lamp. The backlight module includes a first ballast capacitor connected between the inverter and first end of the first lamp, and a second ballast capacitor connected between the inverter and first end of the second lamp. The backlight module includes ballast capacitors each connected between the inverter and one of the lamps.

The inverter includes two alternating-current power sources. The lamps are positioned in sequence, one of the two alternating-current power sources providing power for odd-numbered lamps, and the other of the two alternating-current power sources providing power for even-numbered lamps. The lamps include at least one of cold cathode fluorescent lamps and external electrode fluorescent lamps. The pair of lamps has luminance characteristics similar to a U-shape or C-shape lamp. Each of the elongated lamps extend along a direction parallel to a row of pixels of the display. The lamps are connected to compensate for temperature variations in the lamps to enable the backlight module to have a luminance that is more uniform than a backlight module having pairs of lamps connected in series in which each pair includes lamps that are adjacent to each other. The lamps include m lamps positioned in sequence in which the n-th lamp has an end that is electrically coupled to an end of the (m+1−n)-th lamp. The pair of lamps includes a lamp having the highest position and a lamp having the lowest position among the lamps.

In another aspect, in general, a display includes a display panel having pixels and a backlight module to provide backlight for the display panel. The backlight module includes an inverter to provide power, and elongated fluorescent lamps that are powered by the inverter. The fluorescent lamps include at least a first fluorescent lamp and a second fluorescent lamp that are electrically connected in series, in which the first fluorescent lamp has a first end electrically coupled to the inverter, the second fluorescent lamp has a first end electrically coupled to the inverter, the first fluorescent lamp has a second end electrically coupled to a second end of the second fluorescent lamp, and the first and second fluorescent lamps are spaced apart with at least a third fluorescent lamp positioned between the first and second fluorescent lamps.

In another aspect, in general, a method includes compensating a difference in luminance of different lamps of a backlight module of a display by electrically coupling a first one of the lamps to a second one of the lamps that is spaced apart from the first one of the lamps in which at least a third one of the lamps is positioned between the first one and second one of the lamps.

Implementations of the method may include one or more of the following features. The method includes balancing the temperatures of the first one and second one of the lamps during operation of the first one and second one of the lamps. The method includes compensating variation in electric current flowing through the lamps by electrically coupling a first one of the lamps to a second one of the lamps that are spaced apart from the first one of the lamps in which at least a third one of the lamps is positioned between the first one and the second one of the lamps. The method includes coupling a ballast capacitor between a power source and each of the lamps. The lamps include at least one of cold cathode fluorescent lamps and external electrode fluorescent lamps. The method includes powering the lamps using two alternating-current power sources. The lamps are positioned in sequence, and the method further includes coupling a first alternating-current power source to odd-numbered lamps and coupling a second alternating-current power source to even-numbered lamps. The method further includes connecting the first one of the lamps to the second one of the lamps using a signal line on a circuit board. The method further includes illuminating a liquid crystal display panel using the backlight module.

The disclosed displays and techniques may provided one or more of the following advantages. The backlight module can have a high luminance uniformity. Luminance uniformity can be maintained when there is a large difference in temperature between different lamps. Power lines between the inverter and the fluorescent lamps can be short to reduce leakage current.

The details of one or more implementations are set forth in the accompanying drawings and the description below. Other features, aspects, and advantages will be apparent from the description and drawings, and from the claims.

DETAILED DESCRIPTION

Figure 3:
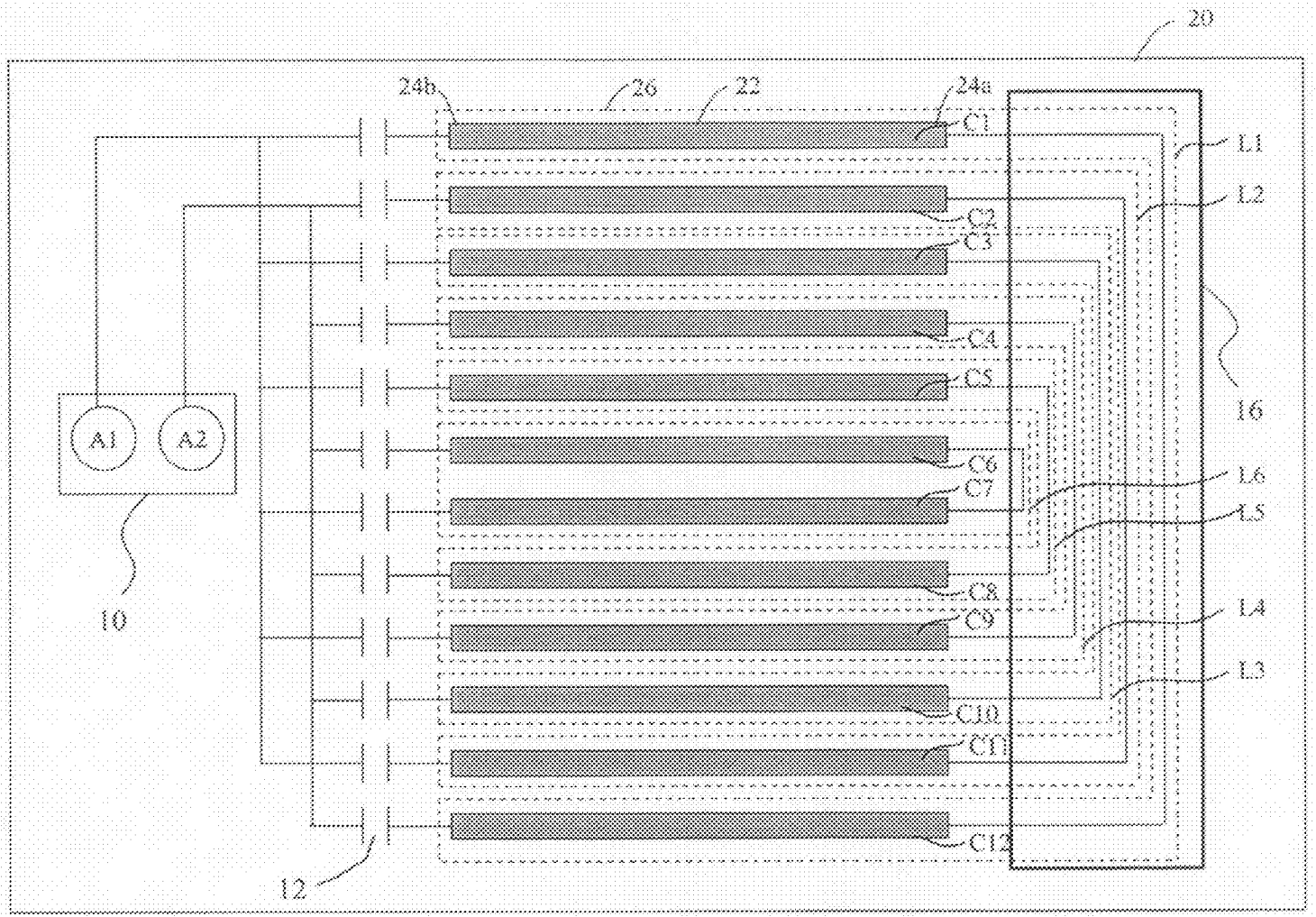
FIG. 3 is a schematic diagram of a backlight module.

FIG. 3 is a schematic diagram of an example of a backlight module 20 of a display (e.g., liquid crystal display) that includes elongated lamps 22 (e.g., C1 to C12) that are positioned horizontally. The lamps 22 can be, e.g., cold cathode fluorescent lamps (CCFL) having straight tubes. The lamps 22 extend along directions that are parallel to rows of pixels of the display. The lamps 22 are connected in a way so as to compensate for differences in luminance of the lamps 22 due to differences in temperatures of the lamps 22. This is achieved by connecting pairs of lamps that are spaced apart and having different temperatures so as to compensate differences in lamp temperatures such that similar amounts of electric currents flow through different pairs of lamps.

When the display is operating in an upright or tilted position, some of the lamps (e.g., C1) are located at positions higher than the other lamps (e.g., C12). In the example of FIG. 3, lamps at an upper portion of the figure represent lamps that are at higher positions when the display is at an upright position. The lamps (as well as other circuitry of the display) generate heat that rises to cause the upper lamps to have higher temperatures than the lower lamps, causing the upper lamps to have a higher luminance than the lower lamps. When a given voltage is applied to a lamp, increasing the temperature of the lamp lowers the internal resistance of the lamp, resulting in an increase in the electric current flowing through the lamp and a corresponding increase in the luminance of the lamp.

Figure 1:
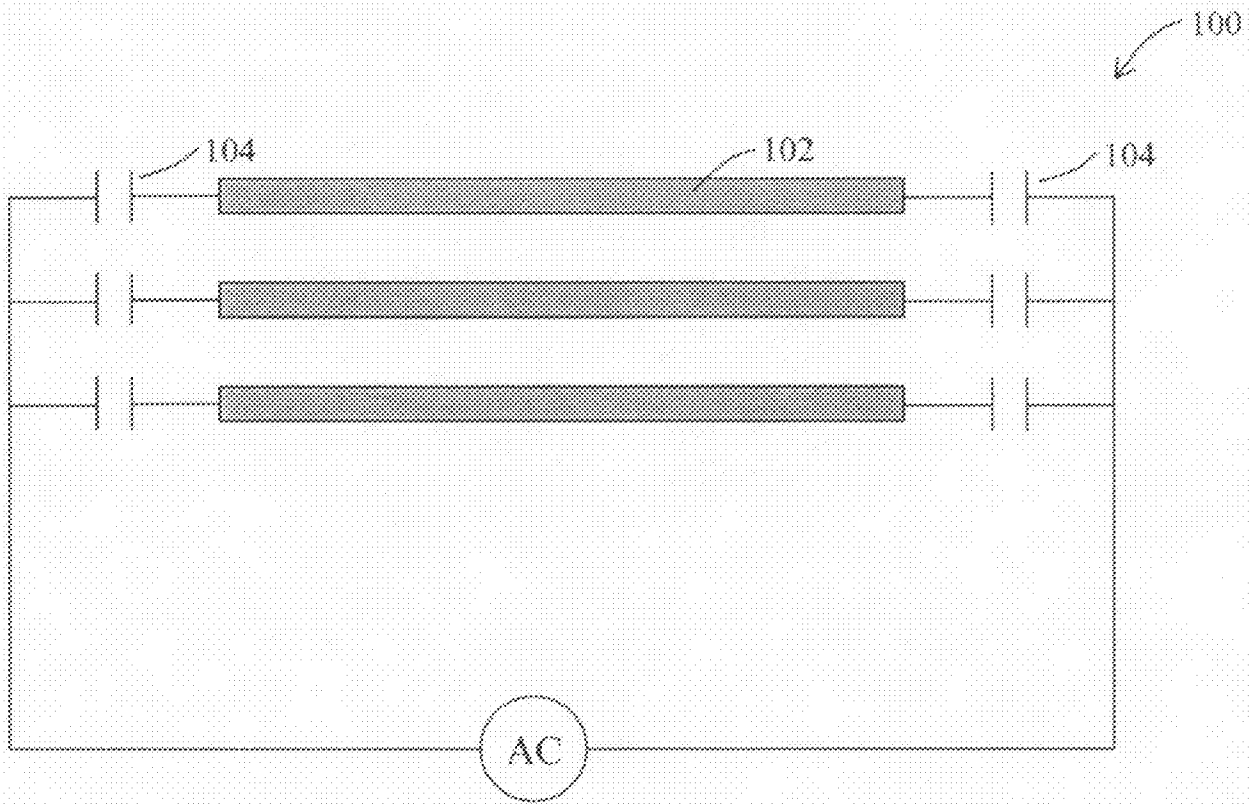
Fig. 1 (Prior Art)
FIGS. 1 and 2 are schematic diagrams of conventional backlight modules.
Figure 2:
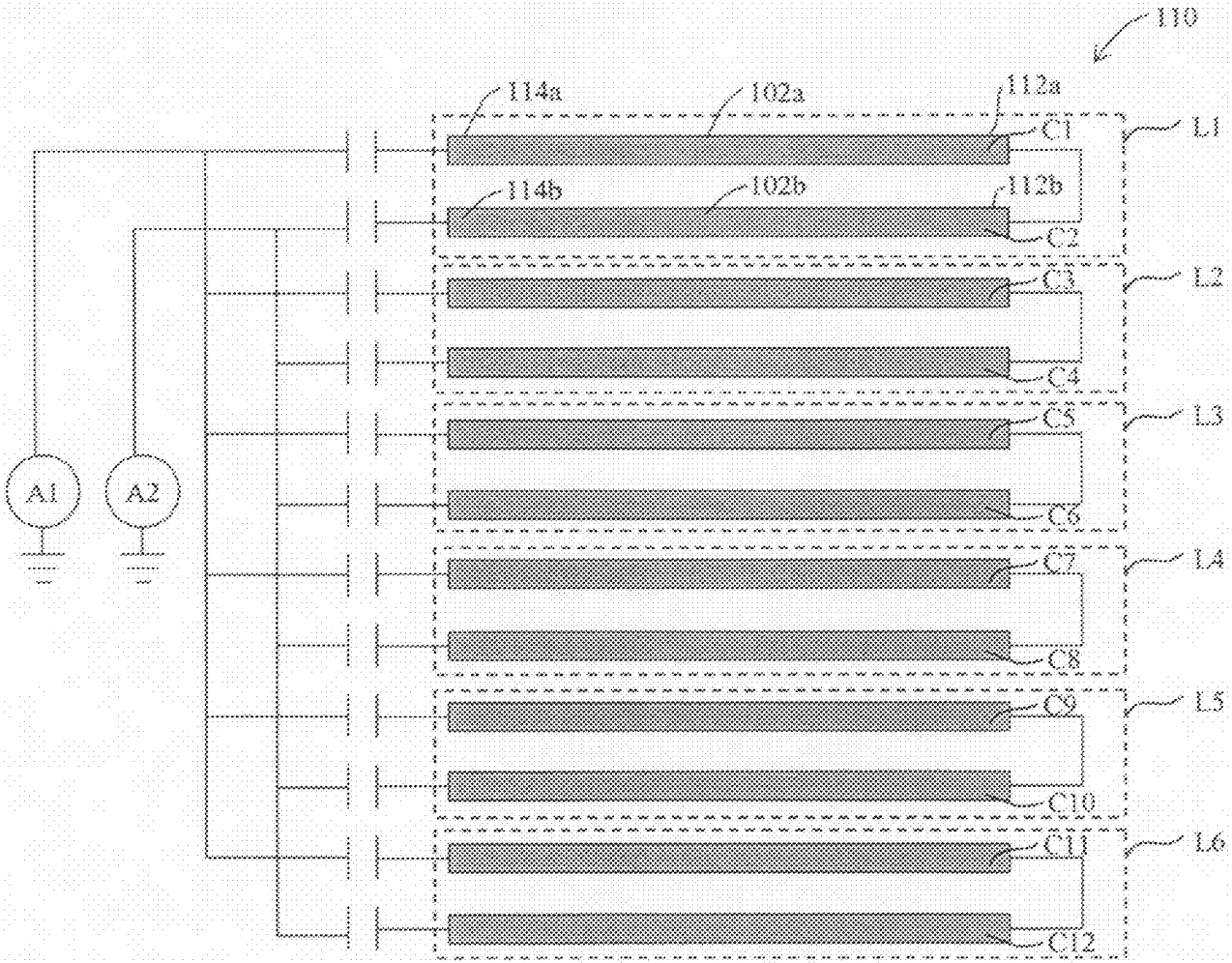
Fig. 2 (Prior Art)

In some examples, to compensate for the temperature differences among different lamps, the lamp (e.g., C1) having the highest position is paired with the lamp (e.g., C12) having the lowest position to form a quasi-U-shaped lamp (e.g., L1, enclosed by dashed lines). The lamp (e.g., C2) having the second highest position is paired with the lamp (e.g., C11) having the second lowest position to form a quasi-U-shaped lamp (e.g., L2 enclosed in dashed lines), and so forth. Using this configuration, the electric currents flowing through different quasi-U-shaped lamps (e.g., L1 to L6) are substantially the same. This is in contrast to the example shown in FIG. 2, in which adjacent lamps (e.g., C1 and C2) are connected to form quasi-U-shaped lamps. In the example of FIG. 2, the quasi-U-shaped lamps having higher positions (e.g., L1) will have higher electric currents than the quasi-U-shaped lamps having lower positions (e.g., L6).

In the example of FIG. 3, several quasi-U-shaped lamps, such as L1 to L5, each include two lamps that are spaced apart with at least one other lamp in between. For example, quasi-U-shaped lamp L1 includes lamps C1 and C2 that are spaced apart with lamps C2 to C11 in between. Quasi-U-shaped lamp L5 includes lamps C5 and C8 that are spaced apart with lamps C6 to C7 in between.

In the example of FIG. 3, each lamp 22 includes a first end 24*a* and a second end 24*b*. The first end 24*a* of the lamp C1 is connected to the first end 24*a* of the lamp C12 to form the quasi-U-shaped lamp L1. Similarly, the first end 24*a* of the lamp C2 is connected to the first end 24*a* of the lamp C11 to form the quasi-U-shaped lamp L2, and so forth. The signal lines for connecting each pair of lamps can be positioned on a circuit board 16 located at, e.g., the right side of the lamps 22 in FIG. 3. The quasi-U-shaped lamp L1 to L6 each has a luminance characteristics similar to a U-shape or C-shape lamp (i.e., a lamp having an elongated tube bent in U-shape or C-shape).

The backlight module 20 includes an inverter 10 that has two power sources A1 and A2 for powering the lamps 22. The power sources A1 and A2 have different phases, e.g., 180° out of phase. The inverter 10 is positioned at one side of the lamps 22 (the left side in FIG. 3). The power sources A1 and A2 are connected to the second ends 24*b* of the lamps 22 so that the power lines between the power sources and the lamps can be short. The power lines carry high voltages, so having shorter power lines results in lower leakage currents. Ballast capacitors 12 are coupled between the power sources and the lamps 22 for generating the ballast voltage. In this example, the power source A1 is coupled to the second end 24*b* of the odd-numbered lamps, e.g., C1, C3, C5, C7, C9, and C11. The power source A2 is coupled to the second end 24*b* of the even-numbered lamps, e.g., C1, C3, C5, C7, C9, and C11.

The lamp connection configuration shown in FIG. 3 has the advantage of compensating a higher lamp current due to a higher lamp temperature by a lower lamp current due to a lower lamp temperature. For example, comparing quasi-U-shaped lamps L1 and L6, the lamp C1 is hotter than the lamp C6, and the lamp C12 is cooler than the lamp C7. By connecting C1 to C12, the tendency to have a higher current due to a higher temperature in C1 (relative to that of C6) is offset by a tendency to have a lower current due to a lower temperature in C12 (relative to that of C7), so that the lamp current flowing through lamps C1 and C12 will be substantially the same as the lamp current flowing through lamps C6 and C7. The same analysis can be applied to the other quasi-U-shaped lamps L2 to L5.

Figure 4:
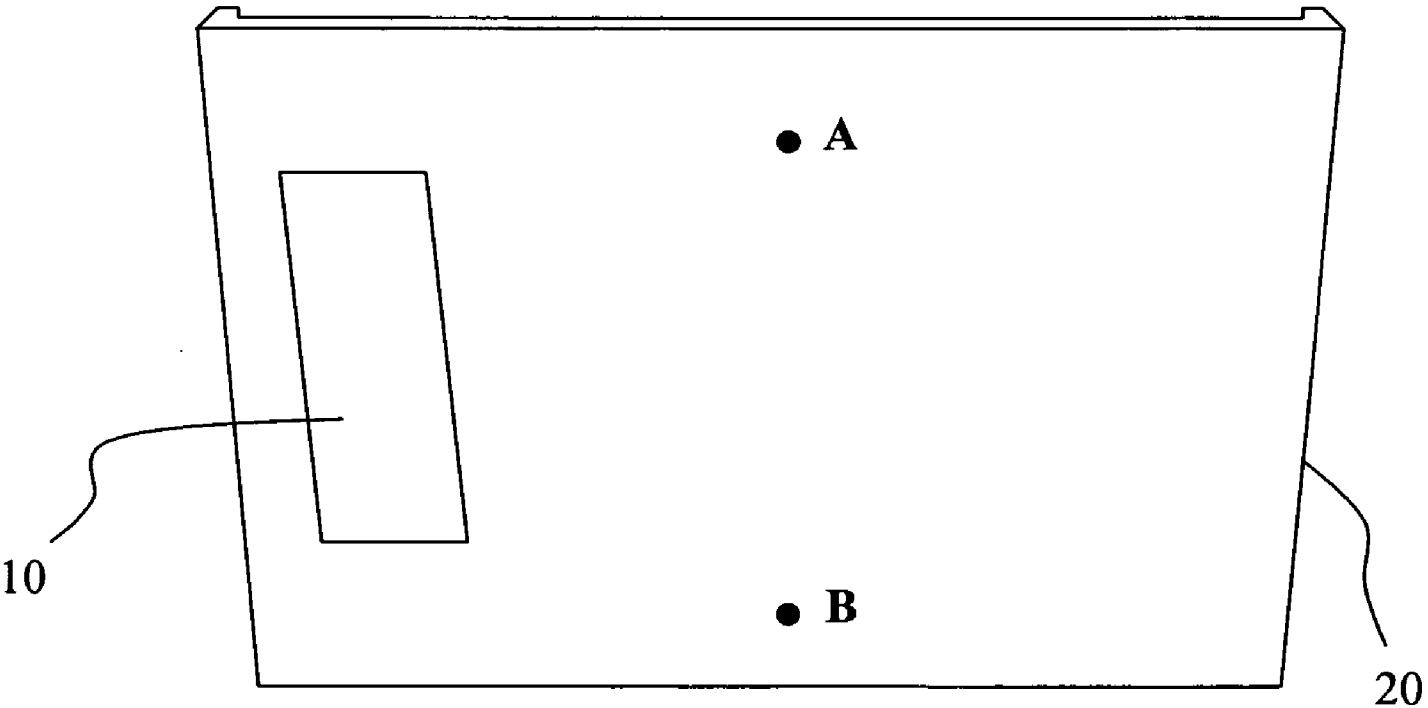
FIG. 4 shows a backlight module.

Referring to FIG. 4, experiments were performed, and temperatures were measured at two locations A and B of the backlight module 20. During the experiments, an upper area (near location A) of the backlight module 20 is covered with a plastic cloth to increase the temperature difference between the upper area and a lower area (around location B) of the backlight module 20. As the data below shows, even when the temperature differences between the upper and lower areas are enhanced, the lamp currents flowing through different quasi-U-shaped lamps are still substantially similar.

Mounted on the backside of the backlight module is a control board (not shown) that has circuitry for controlling the display panel and the backlight module 20. For example, the control board may include a timing controller that receives data and control signals from a host device (e.g., a computer), and controls data drivers and gate drivers to drive the pixels of the display panel. The control board may generate heat that increases the temperature of the lamps 22.

Table 1 shows lamp currents for the various quasi-U-shaped lamps L1 to L6 that are measured when the control board is located at an upper portion of the backside of the backlight module 20.

TABLE 1

| Quasi-U Lamp | Lamp Current (mA) | Note |
|---|---|---|
| L1 | 5.745 | |
| L2 | 5.667 | |
| L3 | 6.275 | Maximum |
| L4 | 5.451 | |
| L5 | 5.892 | |
| L6 | 5.448 | Minimum |

The temperature of location A is 47.7° C., and the temperature of the location B is 37.4° C. In Table 1, the difference between the maximum lamp current and the minimum lamp current (A1) is equal to 6.275−5.448=0.827 mA. As the data in Table 1 shows, even though the lamps and the control board generate heat that causes the temperatures of the lamps C1 to C12 to be different, the electric currents flowing through the quasi-U-shaped lamps do not vary significantly.

Figure 5B:
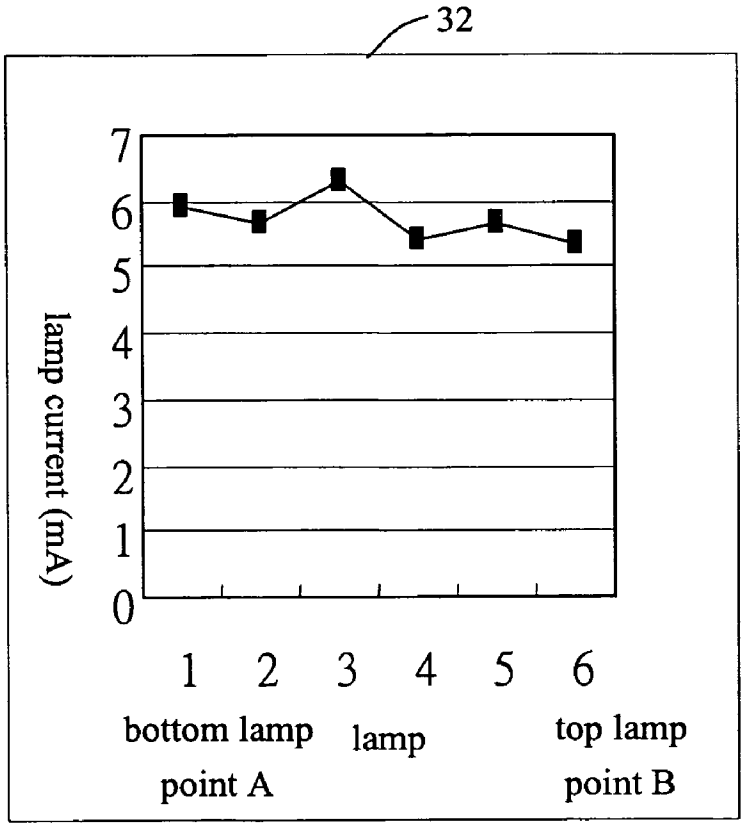
FIGS. 5A, 5B, 6A, and 6B are graphs.
Figure 5A:
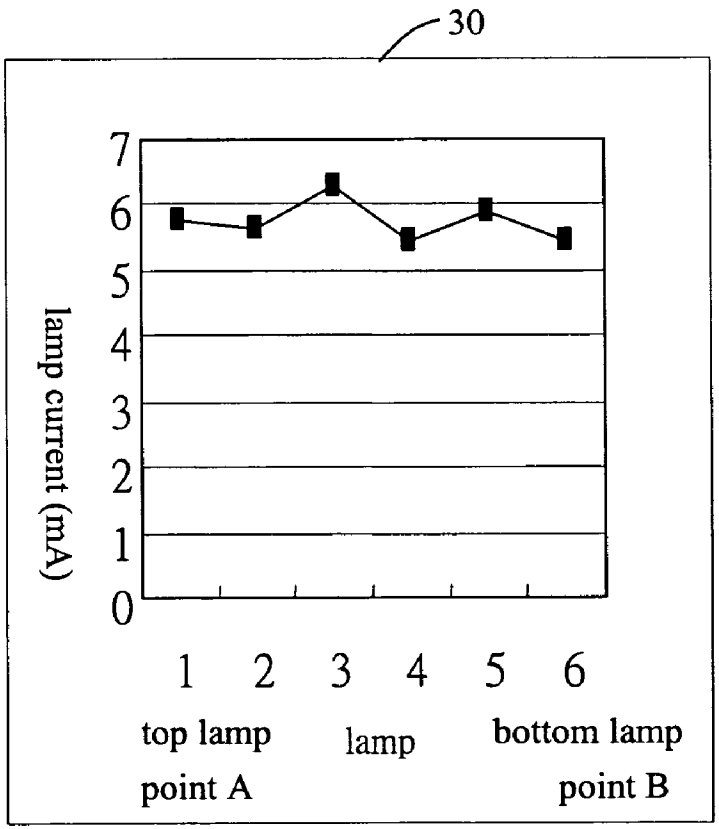

FIG. 5A is a graph 30 that shows the variation in lamp currents among different lamps. The data points in the graph 30 are obtained from Table 1.

Table 2 shows lamp currents that are measured when the control board is located at a lower portion of the backside of the backlight module. The same backlight module 20 was used but rotated 180° so that the control board changed from being located at an upper portion to a lower portion of the backlight module 20.

TABLE 2

| Quasi-U Lamp | Lamp Current (mA) | Note |
|---|---|---|
| L1 | 5.893 | |
| L2 | 5.645 | |
| L3 | 6.293 | Maximum |
| L4 | 5.424 | |
| L5 | 5.693 | |
| L6 | 5.367 | Minimum |

In Table 2, the difference between the maximum lamp current and the minimum lamp current (ΔI) equals to 6.293−5.367=0.926 mA. The temperature of the location A is 37.8° C., and the temperature of the location B is 48.0° C. As the data in Table 2 shows, even though the lamps and the control board generate heat that causes the temperatures of the lamps C1 to C12 to be different, the electric currents flowing through the quasi-U-shaped lamps do not vary significantly.

FIG. 5B is a graph 32 that shows the variation in lamp current among different lamps. The data points in the graph 32 are obtained from Table 2.

For comparison, the lamp currents of the quasi-U-shaped lamps in FIG. 2 are measured. Note that each of the quasi-U-shaped lamps in FIG. 2 includes two lamps that are adjacent to each other. Table 3 shows lamp currents of the backlight module 110 of FIG. 2. The control board is located at an upper portion of the backside of the backlight module 110.

TABLE 3

| Quasi-U Lamp | Lamp Current (mA) | Note |
|---|---|---|
| L1 | 6.21 | Top Lamp |
| L2 | 6.49 | Maximum |
| L3 | 6.259 | |
| L4 | 5.254 | Minimum |
| L5 | 5.474 | |
| L6 | 5.569 | Bottom Lamp |

Figure 6B:
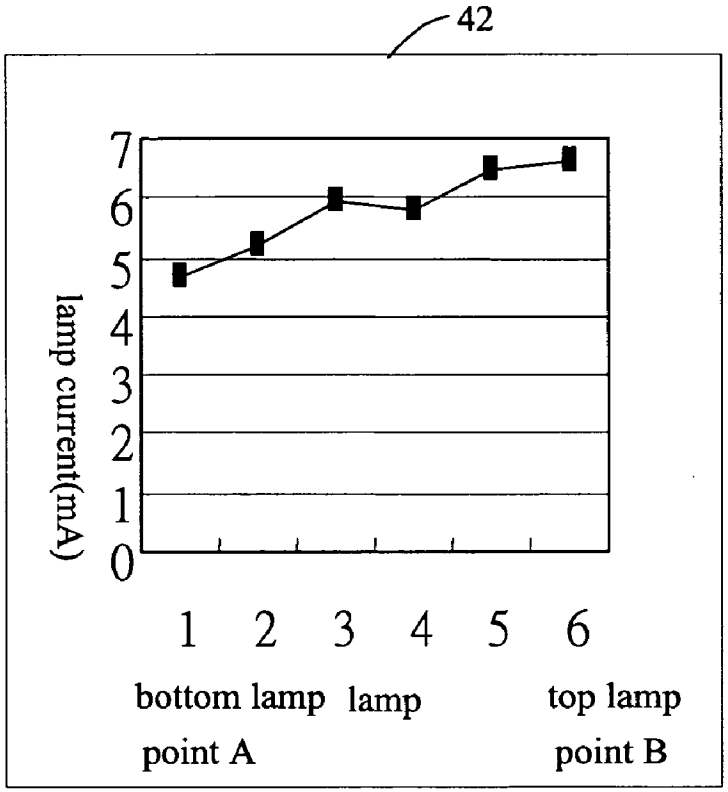
Figure 6A:
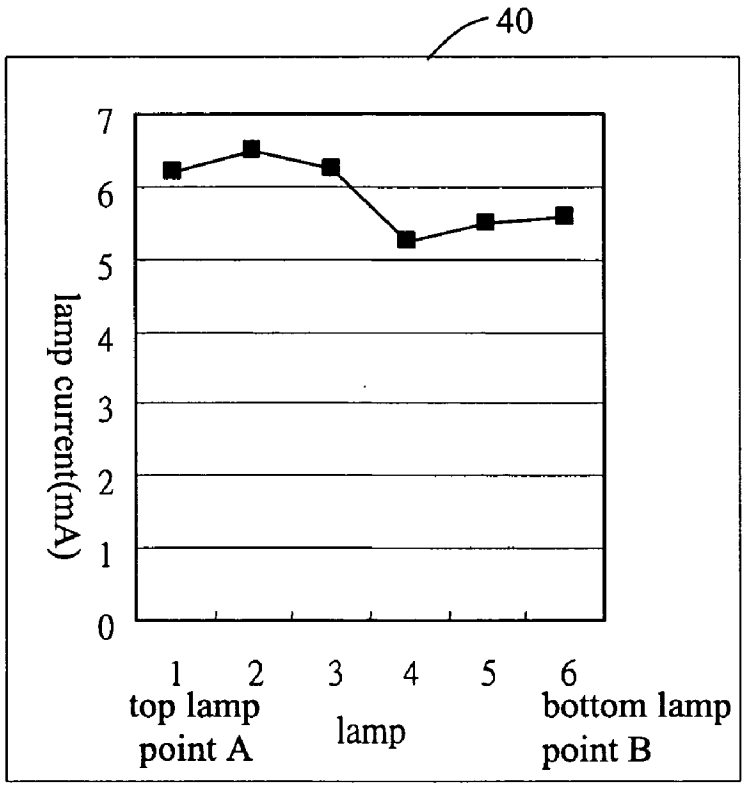

In Table 3, the difference between the maximum lamp current and the minimum lamp current (ΔI) is equal to 6.49−5.254=1.236 mA. The temperature of the location A is 47.4° C., and the temperature of the location B is 37.4° C. FIG. 6A is a graph 40 that shows the variation in lamp current among different lamps of the backlight module 110 of FIG. 2. The data points in the graph 40 are obtained from Table 3.

Table 4 shows lamp currents that are measured when the control board is located at a lower portion of the backside of the backlight module 110 of FIG. 2 (e.g., by turning the backlight module 110 upside down).

TABLE 4

| Quasi-U Lamp | Lamp Current (mA) | Note |
|---|---|---|
| L1 | 4.67 | Bottom Lamp Minimum |
| L2 | 5.172 | |
| L3 | 5.947 | |
| L4 | 5.805 | |
| L5 | 6.45 | |
| L6 | 6.619 | Top Lamp Maximum |

In Table 4, the difference between the maximum lamp current and the minimum lamp current (ΔI) equals to 6.619−4.67=1.949 mA. The temperature of the location A is 37.4° C., and the temperature of Point B is 49.5° C. FIG. 6B is a graph 42 that shows the variation in lamp current among different lamps of FIG. 2. The data points in the graph 42 are obtained from Table 4.

The difference between the maximum and minimum lamp currents in Table 1 is smaller than that shown in Table 3, and the difference between the maximum and minimum lamp currents in Table 2 is smaller than that shown in Table 4. This indicates that the backlight module 20 of FIG. 3 will have a more uniform luminance than that of the backlight module 110 of FIG. 2.

Figure 7:
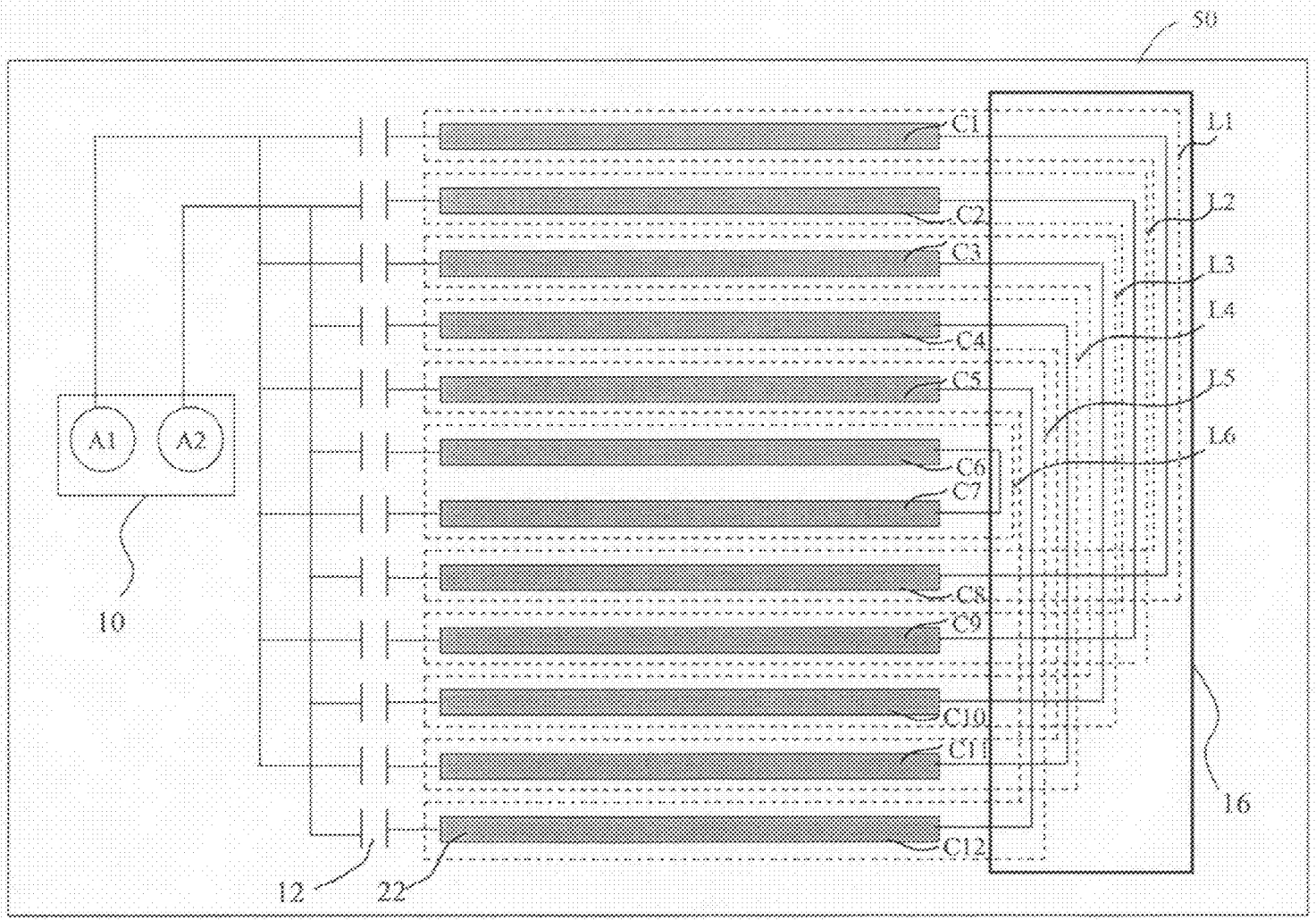
FIG. 7 is a schematic diagram of a backlight module.

FIG. 7 is a schematic diagram of an example of a backlight module 50 of a display that includes elongated lamps 22 (e.g., C1 to C12) similar to those of the backlight module 20 of FIG. 3. The difference between the backlight modules 50 and 20 is that, in the backlight module 50, the lamp C1 is connected to the lamp C8 to form the quasi-U-shaped lamp L1, and the lamp C2 is connected to the lamp C9 to form the quasi-U-shaped lamp L2. Similarly, quasi-U-shaped lamps L3, L4, L5, and L6 are formed by connecting pairs of lamps (C3, C10), (C4, C11), (C5, C12), and (C6, C7), respectively.

Table 5 shows lamp currents of the backlight module 50 of FIG. 7. The control board is located at an upper portion of the backside of the backlight module 50.

TABLE 5

| Quasi-U Lamp | Lamp Current (mA) | Note |
|---|---|---|
| L1 | 5.917 | |
| L2 | 5.665 | Minimum |
| L3 | 6.023 | Maximum |
| L4 | 5.925 | |
| L5 | 5.902 | |
| L6 | 5.924 | |

In Table 5, the difference between the maximum lamp current and the minimum lamp current (ΔI) is equal to 6.023−5.665=0.358 mA. The temperature of the location A is 48.6° C., and the temperature of the location B is 37.2° C.

Figure 8B:
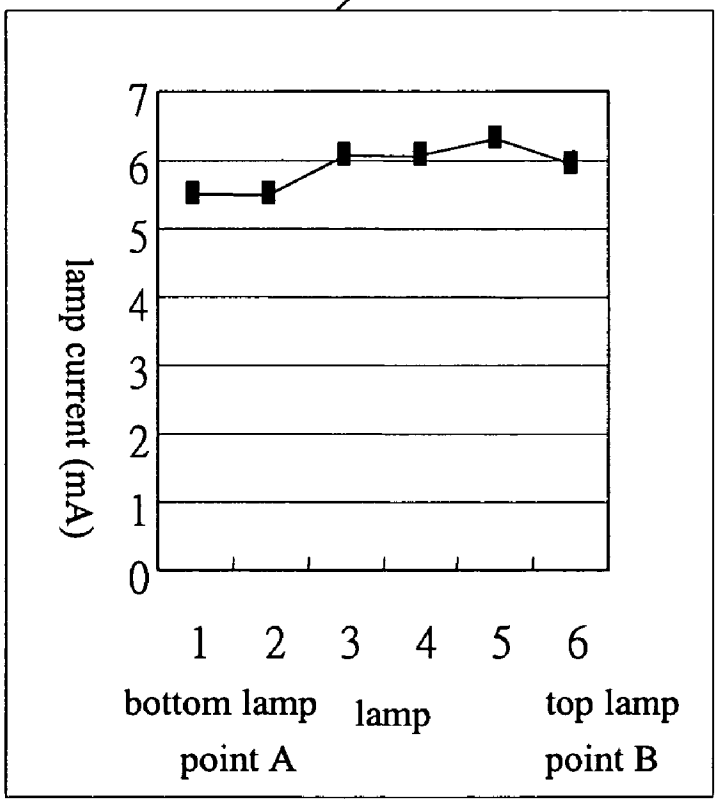
FIGS. 8A and 8B are graphs.
Figure 8A:
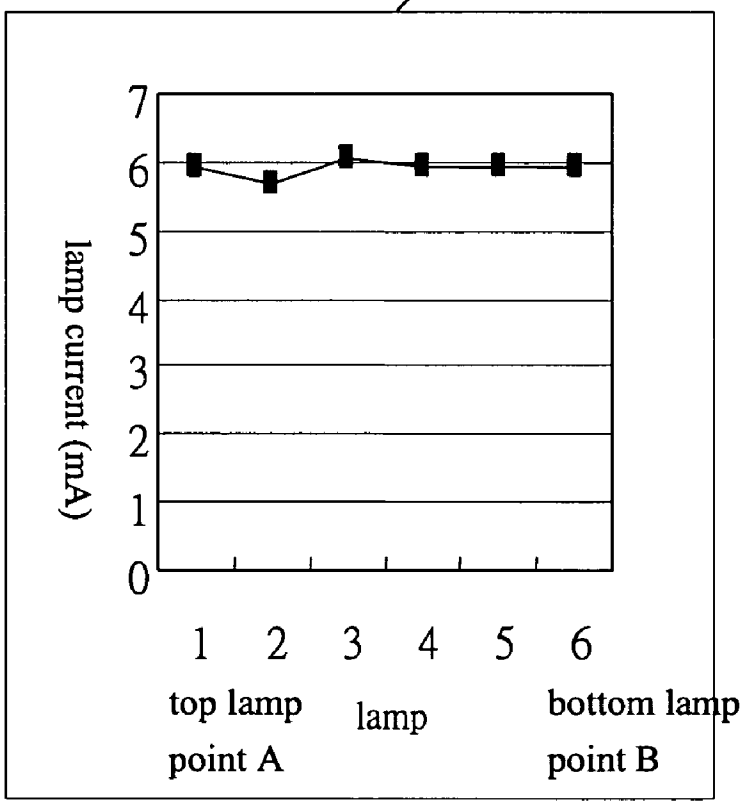

FIG. 8A is a graph 60 that shows the variations in lamp currents among different lamps. The data points in the graph 60 are obtained from Table 5.

Table 6 shows lamp currents of the backlight module 50 of FIG. 7. The measurements were made with the control board located at a lower portion of the backside of the backlight module 50 (e.g., by turning the module 50 upside down).

TABLE 6

| Quasi-U Lamp | Lamp Current (mA) | Note |
|---|---|---|
| L1 | 5.486 | Minimum |
| L2 | 5.499 | |
| L3 | 6.063 | |
| L4 | 6.081 | |
| L5 | 6.317 | Maximum |
| L6 | 5.915 | |

In Table 6, the difference between the maximum lamp current and the minimum lamp current (ΔI) is equal to 6.317−5.486=0.831 mA. The temperature of the location A is 37.6° C., and the temperature of the location B is 48.6° C.

FIG. 8B is a graph 62 that shows the variation in lamp current among different lamps. The data points in the graph 62 are obtained from Table 6.

The difference between the maximum and minimum lamp currents in Table 5 is smaller than that shown in Table 3, and the difference between the maximum and minimum lamp currents in Table 6 is smaller than that shown in Table 4. This indicates that the backlight module 50 of FIG. 7 will have a more uniform luminance than that of the backlight module 110 of FIG. 2.

Figure 9:
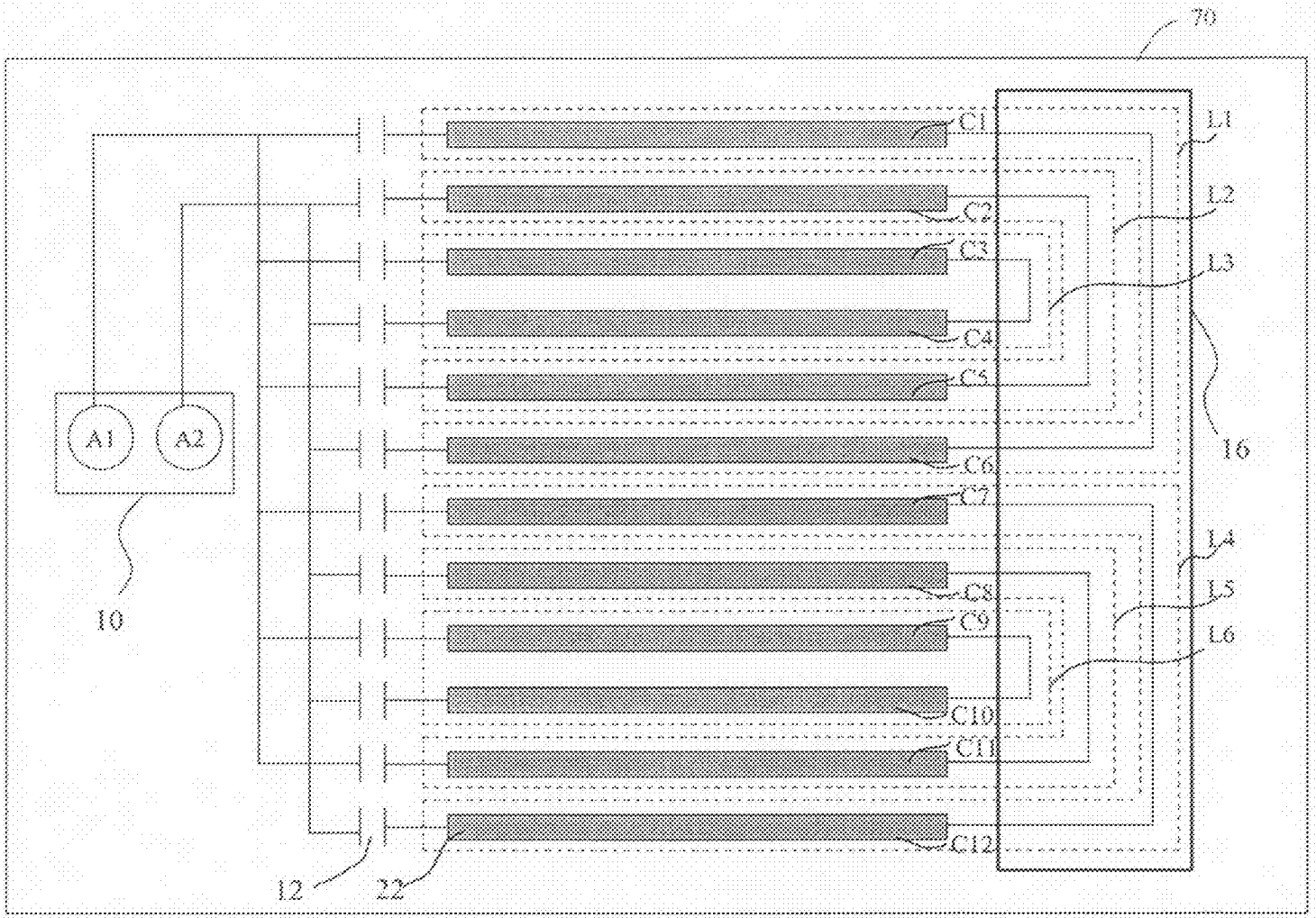
FIG. 9 is a schematic diagram of a backlight module.

FIG. 9 is a schematic diagram of an example of a backlight module 70 of a display that includes elongated lamps 22 (e.g., C1 to C12) similar to those of the backlight module 20 of FIG. 3. The difference between the backlight modules 70 and 20 is that, in the backlight module 70, the lamps C1 and C6 are connected to form a quasi-U-shaped lamp L1, and the lamps C2 and C5 are connected to form a quasi-U-shaped lamp L2. Similarly, quasi-U-shaped lamps L3, L4, L5, and L6 are formed by connecting pairs of lamps (C3, C4), (C7, C12), (C8, C11), and (C9, C10), respectively.

Table 7 shows lamp currents of the backlight module 70 of FIG. 9. The lamp currents are measured when the control board is located at an upper portion of the backside of the backlight module 70.

TABLE 7

| Quasi-U Lamp | Lamp Current (mA) | Note |
|---|---|---|
| L1 | 6.348 | Maximum |
| L2 | 6.251 | |
| L3 | 6.626 | |
| L4 | 5.402 | Minimum |
| L5 | 5.433 | |
| L6 | 5.586 | |

In Table 7, the difference between the maximum lamp current and the minimum lamp current (ΔI) is equal to 6.348−5.402=0.946 mA. The temperature of the location A is 48.6° C., and the temperature of the location B is 36.9° C.

Figure 10B:
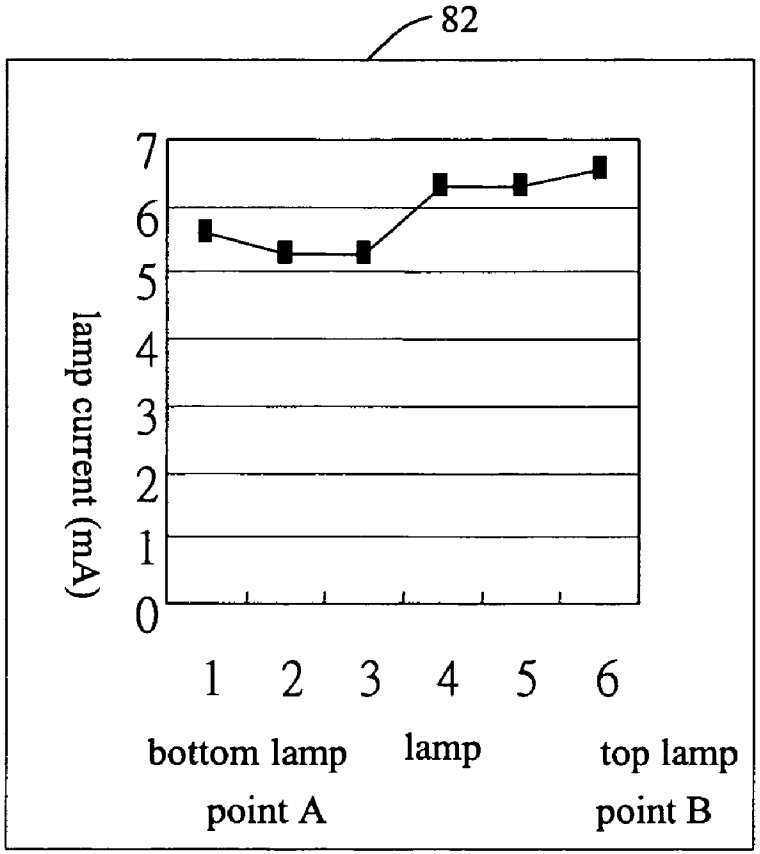
FIGS. 10A and 10B are graphs.
Figure 10A:
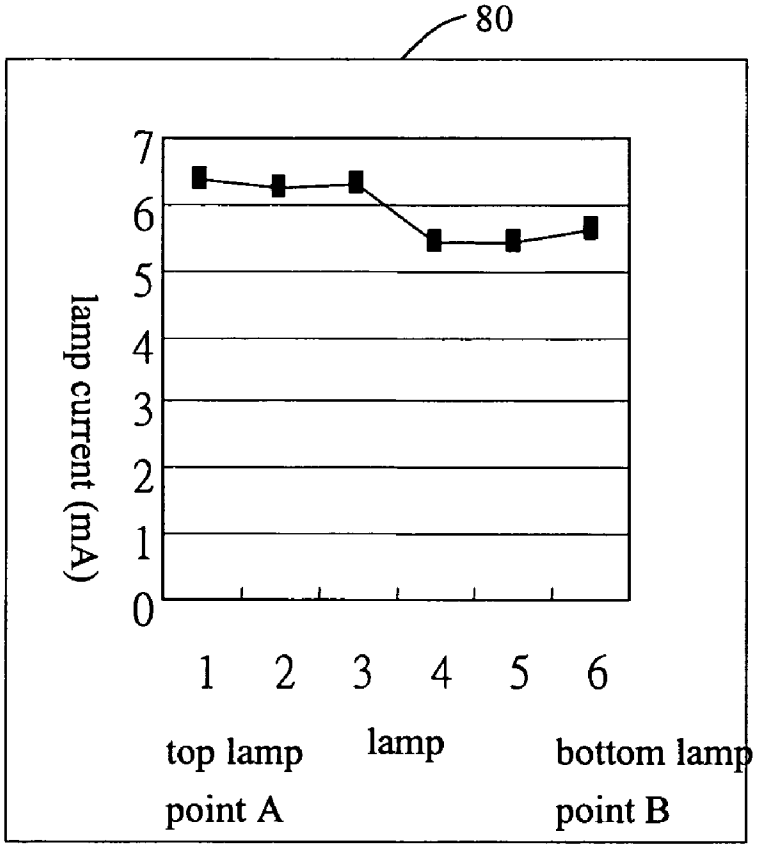

FIG. 10A is a graph 80 that shows the variations in lamp currents among different lamps. The data points in the graph 60 are obtained from Table 5.

Table 8 shows lamp currents that are measured when the control board is located at a lower portion of the backside of the backlight module 70 of FIG. 9 (e.g., by rotating the backlight module 70 upside down).

TABLE 8

| Quasi-U Lamp | Lamp Current (mA) | Note |
|---|---|---|
| L1 | 5.613 | |
| L2 | 5.256 | Minimum |
| L3 | 5.311 | |
| L4 | 6.298 | |
| L5 | 6.311 | |
| L6 | 6.541 | Maximum |

In Table 8, the difference between the maximum lamp current and the minimum lamp current (ΔI) is equal to 6.541−5.256=1.285 mA. The temperature of the location A is 37.4° C., and the temperature of Point B is 48.7° C.

FIG. 10B is a graph 82 that shows the variation in lamp current among different lamps. The data points in the graph 82 are obtained from Table 8.

The difference between the maximum and minimum lamp currents in Table 7 is smaller than that shown in Table 3, and the difference between the maximum and minimum lamp currents in Table 8 is smaller than that shown in Table 4. This indicates that the backlight module 70 of FIG. 9 will have a more uniform luminance than that of the backlight module 110 of FIG. 2.

Table 9 shows a comparison of the measurement results of the backlight module 110 (FIG. 2), backlight module 20 (FIG. 3), backlight module 50 (FIG. 7), and backlight module 70 (FIG. 9).

TABLE 9

| | Backlight module 110 of FIG. 2 ΔI (mA) | Backlight module 20 of FIG. 3 ΔI (mA) | Backlight module 50 of FIG. 7 ΔI (mA) | Backlight module 70 of FIG. 9 ΔI (mA) |
|---|---|---|---|---|
| Control board at upper position | 1.236 | 0.827 | 0.358 | 0.946 |
| Control board at lower position | 1.949 | 0.926 | 0.831 | 1.285 |
| ΔΔI | 0.713 | 0.099 | 0.473 | 0.339 |

In Table 9, the backlight module 20 has the smallest ΔΔI value. This indicates that the method for connecting pairs of lamps to form the quasi-U-shaped lamps of the backlight module 20 of FIG. 3 is better than the other examples.

Although some implementations have been discussed above, other implementations and applications are also within the scope of the following claims. For example, the lamps 22 can have different shapes and lengths from those described above. The connection of pairs of lamps can be different from those described above. The inverter 10 can have more than two power sources.

What is claimed is:

1. A display comprising:

a display panel comprising pixels; and a backlight module configured to provide backlight for the display panel, the backlight module comprising an inverter to provide power, and elongated fluorescent lamps, each having a first end and a second end, that comprise at least a first fluorescent lamp and a second fluorescent lamp that are electrically connected in series, in which the first ends of the first fluorescent lamp and the second fluorescent lamp are electrically coupled to the inverter, the second end of the first fluorescent lamp is electrically coupled to the second end of the second fluorescent lamp, and the first and second fluorescent lamps are spaced apart with at least a third fluorescent lamp positioned between the first and second fluorescent lamps, the first end of the third fluorescent lamp being connected to the inverter and the second end of the third fluorescent lamp being connected to the second end of a fourth fluorescent lamp spaced apart from the third fluorescent lamp such that the second fluorescent lamp is between the third and fourth fluorescent lamps, wherein the first end of the fourth fluorescent lamp is electrically coupled to the inverter;

wherein each lamp comprises a straight tube with connectors at both ends of the straight tube, all signal lines for connecting, without any intervening power source, two lamps in every pair-wise combination of the lamps are located on a first side of the backlight module, all signal lines for connecting each lamp and the inverter are located on a second side of the backlight module, and the first and second sides are different.

2. The display of claim 1 wherein the connection of the lamps compensate for differences in temperatures of the lamps during operation of the lamps.

3. The display of claim 1 wherein the first and second lamps are connected in a quasi-U-shape and the third and fourth lamps are connected in a quasi-U shape.

4. The display of claim 1, further comprising a circuit board having at least one signal line for connecting at least one pair of lamps.

5. The display of claim 1 wherein the elongated fluorescent lamps extend along directions that are parallel to one another.

6. The display of claim 1 wherein the backlight module comprises a first ballast capacitor connected between the inverter and first end of the first lamp, and a second ballast capacitor connected between the inverter and first end of the second lamp.

7. The display of claim 1 wherein the backlight module comprises a third ballast capacitor connected between the inverter and first end of the third lamp, and a fourth ballast capacitor connected between the inverter and first end of the fourth lamp.

8. The display of claim 1 wherein the fluorescent lamps comprise at least one of cold cathode fluorescent lamps and external electrode fluorescent lamps.

9. The display of claim 1 wherein each pair of lamps has luminance characteristics similar to a U-shape or C-shape lamp.

10. The display of claim 1 wherein each of the elongated fluorescent lamps extends along a direction parallel to a row of pixels of the display.

11. The display of claim 1 wherein the lamps are connected to compensate for temperature variations in the lamps to enable the backlight module to have a luminance that is more uniform than a backlight module having pairs of lamps connected in series in which each pair includes lamps that are adjacent to each other.

12. A display comprising:

a display panel comprising pixels; and a backlight module configured to provide backlight for the display panel, the backlight module comprising an inverter to provide power, and elongated fluorescent lamps, each having a first end and a second end, that comprise at least a first fluorescent lamp and a second fluorescent lamp that are electrically connected in series, in which the first ends of the first fluorescent lamp and the second fluorescent lamp are electrically coupled to the inverter, the second end of the first fluorescent lamp is electrically coupled to the second end of the second fluorescent lamp without any intervening power source, and the first and second fluorescent lamps are spaced apart with at least a third fluorescent lamp positioned between the first and second fluorescent lamps, the third fluorescent lamp having a first end and a second end, wherein the first end of the third fluorescent lamp is connected to the inverter and the second end of the third fluorescent lamp is connected to the second end of a fourth fluorescent lamp spaced apart from the third fluorescent lamp such that the second fluorescent lamp is between the third and fourth fluorescent lamps;

wherein the first ends of the first, second, third, and fourth fluorescent lamps are connected to a same inverter, the first ends of the first, second, third, and fourth lamps are on a first side of the backlight module, the second ends of the first, second, third, and fourth lamps are on a second side of the backlight module, the inverter is on the first side of the backlight module, and the second end of the third lamp is not connected to the second end of the first or the second lamp.

13. The display of claim 12 wherein the connection of the fluorescent lamps compensate for differences in temperatures of the lamps during operation of the lamps.

14. The display of claim 12 wherein the first and second fluorescent lamps are connected in a quasi-U-shape and the third and fourth fluorescent lamps are connected in a quasi-U shape.

15. The display of claim 12, further comprising a circuit board having at least one signal line for connecting at least one pair of fluorescent lamps.

16. The display of claim 12 wherein the elongated fluorescent lamps extend along directions that are parallel to one another.

17. The display of claim 12 wherein the backlight module comprises a first ballast capacitor connected between the inverter and first end of the first fluorescent lamp, and a second ballast capacitor connected between the inverter and first end of the second fluorescent lamp.

18. The display of claim 12 wherein the backlight module comprises a third ballast capacitor connected between the inverter and first end of the third fluorescent lamp, and a fourth ballast capacitor connected between the inverter and first end of the fourth fluorescent lamp.

19. The display of claim 12 wherein the fluorescent lamps comprise at least one of cold cathode fluorescent lamps and external electrode fluorescent lamps.

20. The display of claim 12 wherein each pair of fluorescent lamps has luminance characteristics similar to a U-shape or C-shape lamp.

21. The display of claim 12 wherein each of the elongated fluorescent lamps extends along a direction parallel to a row of pixels of the display.

22. The display of claim 12 wherein the fluorescent lamps are connected to compensate for temperature variations in the lamps to enable the backlight module to have a luminance that is more uniform than a backlight module having pairs of lamps connected in series in which each pair includes lamps that are adjacent to each other.

23. A method comprising:

compensating a difference in luminance of different lamps of a backlight module of a display by electrically coupling a first one of the lamps to a second one of the lamps that is spaced apart from the first one of the lamps in which at least a third one of the lamps is positioned between the first one and second one of the lamps, wherein the third one of the lamps is electrically coupled in series with a fourth one of the lamps that is spaced apart from the third one of the lamps such that the second one of the lamps is between the third one and fourth one of the lamps;

wherein each of the first, second, third, and fourth one of the lamps has a first end and a second end, the first ends of the first, second, third, and fourth one of the lamps are connected to a same inverter, the first ends of the first, second, third, and fourth one of the lamps are on a first side of the backlight module, the second ends of the first, second, third, and fourth one of the lamps are on a second side of the backlight module, the power inverter is on the first side of the backlight module, and the second end of the third lamp is not connected to the second end of the first or the second lamp.

24. The method of claim 23, further comprising balancing the temperatures of the first one and second one of the lamps during operation of the first one and second one of the lamps.

25. The method of claim 23, further comprising coupling a ballast capacitor between the power source and each of the lamps.

26. The method of claim 23 wherein the lamps comprise at least one of cold cathode fluorescent lamps and external electrode fluorescent lamps.

27. The method of claim 23, further comprising connecting the first one of the lamps to the second one of the lamps using a signal line on a circuit board.

28. The method of claim 23, further comprising illuminating a liquid crystal display panel using the backlight module.

29. The method of claim 23, further comprising connecting the third one of the lamps to the fourth one of the lamps using a signal line on a circuit board.

30. A display comprising:

a display panel comprising pixels; and a backlight module configured to provide backlight for the display panel, the backlight module comprising an inverter to provide power, and elongated fluorescent lamps that comprise at least a first fluorescent lamp and a second fluorescent lamp that are electrically connected in series such that the first and second lamps are connected in a quasi-U-shape, a third fluorescent lamp and a fourth fluorescent lamp that are electrically connected in series such that the third and fourth lamps are connected in a quasi-U-shape, in which the first fluorescent lamp has a first end electrically coupled to the inverter, the second fluorescent lamp has a first end electrically coupled to the inverter, the first fluorescent lamp has a second end electrically coupled to a second end of the second fluorescent lamp without any intervening power source, the third fluorescent lamp has a first end electrically coupled to the inverter, the fourth fluorescent lamp has a first end electrically coupled to the inverter, the third fluorescent lamp has a second end electrically coupled to a second end of the fourth fluorescent lamp without any intervening power source, and the fluorescent lamps are positioned such that the third fluorescent lamp is between the first and second fluorescent lamps and the second fluorescent lamp is between the third and fourth fluorescent lamp.

* * * * *